US009784496B2

(12) United States Patent
Choi et al.

(10) Patent No.: US 9,784,496 B2
(45) Date of Patent: Oct. 10, 2017

(54) AIR CONDITIONER AND METHOD OF CONTROLLING THE SAME

(71) Applicant: SAMSUNG ELECTRONICS CO., LTD., Suwon-si, Gyeonggi-do (KR)

(72) Inventors: Byung Ik Choi, Seoul (KR); Tae Gyoon Noh, Suwon-si (KR); Jun Hoe Choi, Hwaseong-si (KR); Ji Hoon Ha, Suwon-si (KR); Jeong Su Han, Suwon-si (KR); Jong Soo Hong, Suwon-si (KR); Hyung Min Son, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 403 days.

(21) Appl. No.: 14/301,619

(22) Filed: Jun. 11, 2014

(65) Prior Publication Data

US 2015/0114014 A1 Apr. 30, 2015

(30) Foreign Application Priority Data

Oct. 24, 2013 (KR) ..... 10-2013-0127173

(51) Int. Cl.

| | |
|---|---|
| ***F25D 21/06*** | (2006.01) |
| ***F25D 29/00*** | (2006.01) |
| ***F24F 1/06*** | (2011.01) |
| ***F24F 11/00*** | (2006.01) |
| ***F25D 17/06*** | (2006.01) |
| ***F25D 27/00*** | (2006.01) |
| ***F25D 31/00*** | (2006.01) |

(52) U.S. Cl.

CPC ..... *F25D 29/00* (2013.01); *F24F 1/06* (2013.01); *F24F 11/001* (2013.01); *F24F 11/0012* (2013.01); *F25D 17/06* (2013.01); *F25D 27/00* (2013.01); *F25D 31/005* (2013.01)

(58) Field of Classification Search

CPC ..... F25D 21/04; F25D 17/065; F25B 47/022
USPC ..... 62/275, 498, 186, 126, 129, 168
See application file for complete search history.

(56) References Cited

U.S. PATENT DOCUMENTS 4,406,133 A * 9/1983 Saunders ..... F25B 13/00 62/155
5,509,154 A * 4/1996 Shafer ..... A47C 27/082 318/16

FOREIGN PATENT DOCUMENTS

| | | |
|---|---|---|
| EP | 0 787 961 A2 | 8/1997 |
| JP | 5-323044 | 12/1993 |
| JP | 2003-74911 | 3/2003 |
| JP | 2006-300447 | 11/2006 |
| KR | 10-2013-0090517 | 8/2013 |

OTHER PUBLICATIONS

European Search Report issued Mar. 24, 2015 in corresponding European Patent Application No. 14174091.0.

* cited by examiner

*Primary Examiner* — Melvin Jones
(74) *Attorney, Agent, or Firm* — Staas & Halsey LLP

(57) ABSTRACT

An air conditioner includes an indoor unit, an outdoor unit including an outdoor fan, a sensor unit mounted at an upper portion of the outdoor unit to sense snow piled up on the outdoor unit, and a control unit to determine whether snow is piled up or not based on an output from the sensor unit and control an operation of the outdoor fan to remove snow when snow is piled up based on the determination. The sensor unit includes a photo sensor and a temperature sensor.

15 Claims, 13 Drawing Sheets

AIR CONDITIONER AND METHOD OF CONTROLLING THE SAME

CROSS-REFERENCE TO RELATED APPLICATIONS

This application claims the benefit of Korean Patent Application No. 10-2013-0127173, filed on Oct. 24, 2013, in the Korean Intellectual Property Office, the disclosure of which is incorporated herein in its entirety by reference.

BACKGROUND

1. Field

Embodiments of the present disclosure relate to a snow sensor to sense piling up of snow on an air conditioner and a method of controlling the same.

2. Description of the Related Art

Air conditioners cool or heat indoor air using a refrigeration cycle of a refrigerant including a compressor, a condenser, an expansion device, and an evaporator to provide a pleasant indoor environment to a user.

In general, an air conditioner includes an indoor unit installed in an indoor space and an outdoor unit including a compressor, an expansion device, and a heat exchanger and supplying a refrigerant to the indoor unit.

Such air conditioners may include one outdoor unit and a plurality of indoor units coupled to the outdoor unit to perform air conditioning in a plurality of rooms of a building via simultaneous or individual operations thereof. Alternatively, air conditioners may include a plurality of outdoor units and a plurality of indoor units respectively coupled the outdoor units to perform air conditioning in a plurality of rooms via simultaneous or individual operations thereof.

In this case, depending on the weather conditions, snow may be piled up on an outdoor unit of an air conditioner and block airflow through the outdoor unit. In this regard, a method of removing the snow by periodically driving a snow blowing fan to prevent an air conditioner from malfunctioning is disclosed.

However, an outdoor unit may be unnecessarily driven even when snow is not piled up according to this method since the fan is regularly driven regardless of piling up of snow, thereby causing a waste of energy.

Furthermore, snow may be piled up on the outdoor unit blocking airflow of the outdoor unit when there is a large amount of snow fall in a short period of time since the fan is not continuously driven.

SUMMARY

Therefore, it is an aspect of the present disclosure to provide a snow sensor sensing piling up of snow on an outdoor unit of an air conditioner to prevent unnecessary operations of the outdoor unit of the air conditioner while snow is piled up thereon.

Additional aspects of the disclosure will be set forth in part in the description which follows and, in part, will be from the description, or may be learned by practice of the disclosure.

In accordance with one aspect of the present disclosure, an air conditioner includes an indoor unit, an outdoor unit including an outdoor fan, a sensor unit mounted at an upper portion of the outdoor unit to sense snow piled up on the outdoor unit, and a control unit to determine whether snow is piled up or not based on an output from the sensor unit and control an operation of the outdoor fan to remove snow when snow is piled up based on the determination. The sensor unit includes a photo sensor and a temperature sensor.

The air conditioner may further include a heater disposed around the sensor unit to maintain operational performance at a low temperature and supply heat to surroundings of the sensor unit.

The control unit may determine that snow is piled up when an output from the temperature sensor is less than a predetermined first temperature, an output from the photo sensor is changed, and the changed output is maintained for a predetermined first time period.

The control unit may simultaneously control an operation of the outdoor fan and control the heater to supply heat while removing the piled up snow.

The control unit may determine that foreign matter exists when an output from the temperature sensor is greater than a predetermined first temperature and an output from the photo sensor is changed.

The photo sensor may be a position sensitive detector (PSD) sensor.

In accordance with one aspect of the present disclosure, an air conditioner includes an indoor unit, an outdoor unit including an outdoor fan, a sensor unit mounted at an upper portion of the outdoor unit to sense snow piled up on the outdoor unit, and a control unit to determine whether snow is piled up or not based on an output from the sensor unit and control an operation of the outdoor fan to remove snow when snow is piled up based on the determination. The sensor unit includes a capacitive sensor.

The air conditioner may further include a heater disposed around the sensor unit supply heat to surroundings of the sensor unit.

The control unit may drive the heater, determine that snow is piled up when an output from the capacitive sensor is changed after snow is melted into water by driving of the heater and the changed output is maintained for a predetermined second time period, and drive the heater to continuously supply heat or controls an operation of the outdoor fan to remove the piled up snow when snow is piled up.

The sensor unit may further include a temperature sensor, and the control unit may control driving of the heater to melt snow when an output from the temperature sensor is less than a predetermined second temperature when the driving of the heater is determined.

In accordance with one aspect of the present disclosure, a method of controlling an air conditioner including an indoor unit, an outdoor unit including an outdoor fan, and a sensor unit mounted at an upper portion of the outdoor unit to sense snow piled up on the outdoor unit, wherein the sensor unit includes a photo sensor and a temperature sensor includes determining that snow is piled up when an output from the temperature sensor is less than a predetermined first temperature, an output from the photo sensor is changed and the changed output is maintained for a predetermined first time period, and removing the piled up snow by driving the outdoor fan.

The air conditioner may further include a heater around the sensor unit, and the heater may be controlled to supply heat while controlling an operation of the outdoor fan when the piled up snow is removed.

It may be determined that foreign matter exists when an output from the temperature sensor is greater than a predetermined first temperature.

In accordance with one aspect of the present disclosure, a method of controlling an air conditioner including an indoor unit, an outdoor unit including an outdoor fan, a sensor unit mounted at an upper portion of the outdoor unit to sense snow piled up on the outdoor unit, and a heater disposed around the sensor unit, wherein the sensor unit includes a capacitive sensor includes driving the heater, determining that snow is piled up when an output from the capacitive sensor is changed after driving of the heater, and the changed output is maintained for a predetermined second time period, and controlling the heater to continuously supply heat or the outdoor fan to remove the pile up snow upon determining that snow is piled up.

The sensor unit may further include a temperature sensor, and the heater may be driven when an output from the temperature sensor is less than a predetermined second temperature.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
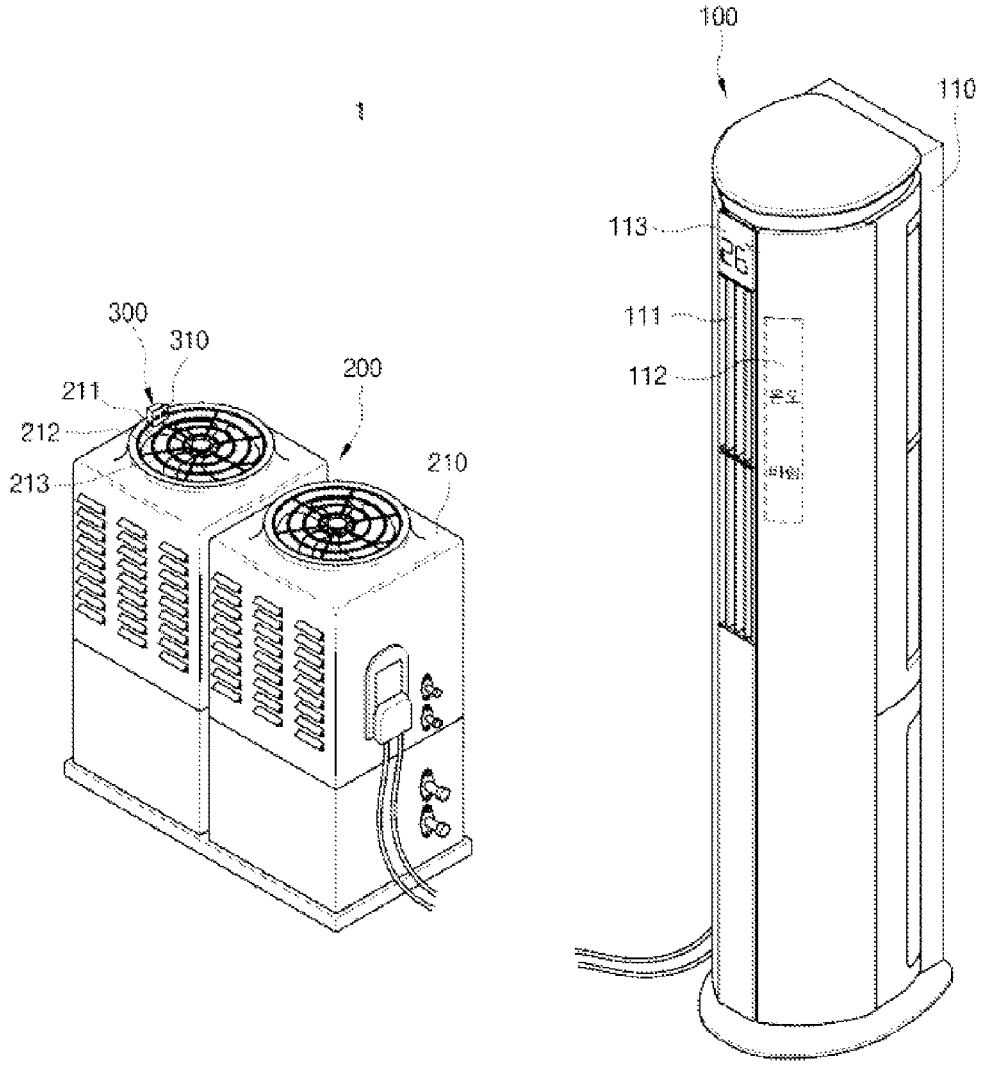
FIG. 1 is a view illustrating an appearance of an air conditioner according to an embodiment of the present disclosure.

Reference will now be made in detail to the embodiments of the present disclosure, examples of which are illustrated in the accompanying drawings, wherein like reference numerals refer to like elements throughout.

Hereinafter, embodiments of the present disclosure will be described in detail with reference to the drawings.

FIG. 1 is a view illustrating an appearance of an air conditioner 1 according to an embodiment of the present disclosure.

Referring to FIG. 1, the air conditioner 1 includes at least one indoor unit 100 installed in an indoor space and performing heat exchange between indoor air and a refrigerant, at least one outdoor unit 200 installed in an outdoor space and performing heat exchange between outdoor air and the refrigerant, and a sensor unit 300 sensing outdoor conditions.

The indoor unit 100 includes an indoor unit main body 110 defining an appearance of the indoor unit 100, an indoor unit air discharge port 111 disposed on a front surface of the indoor unit main body 110 and discharging heat-exchanged air, a manipulation panel 112 receiving user instructions regarding operations of the air conditioner 1, and a display panel 113 displaying information regarding the operations of the air conditioner 1.

The outdoor unit 200 includes an outdoor unit main body 210 defining an appearance of the outdoor unit 200, an outdoor unit air discharge port 211 disposed at one side of the outdoor unit main body 210 and discharging heat-exchanged air, an outdoor fan 212 disposed at the air discharge port 211, and a grille 213 disposed at an upper portion of the outdoor fan 212.

The sensor unit 300 is mounted at an upper portion of the grille 213 and includes a housing 310 defining an appearance thereof. The structure of the housing 310 will be described in detail later.

The air conditioner 1 may further include an air cleaning unit, a ventilating unit, a humidifying unit, a dehumidifying unit, a heater, and the like in addition to the indoor unit 100, the outdoor unit 200, and the sensor unit 300. These units may be integratedly-controlled in a state of being coupled to the indoor unit 100 or the outdoor unit 200. In this regard, the numbers of the outdoor units 200 and the indoor units 100 are not limited by the illustrated drawings.

Figure 2:
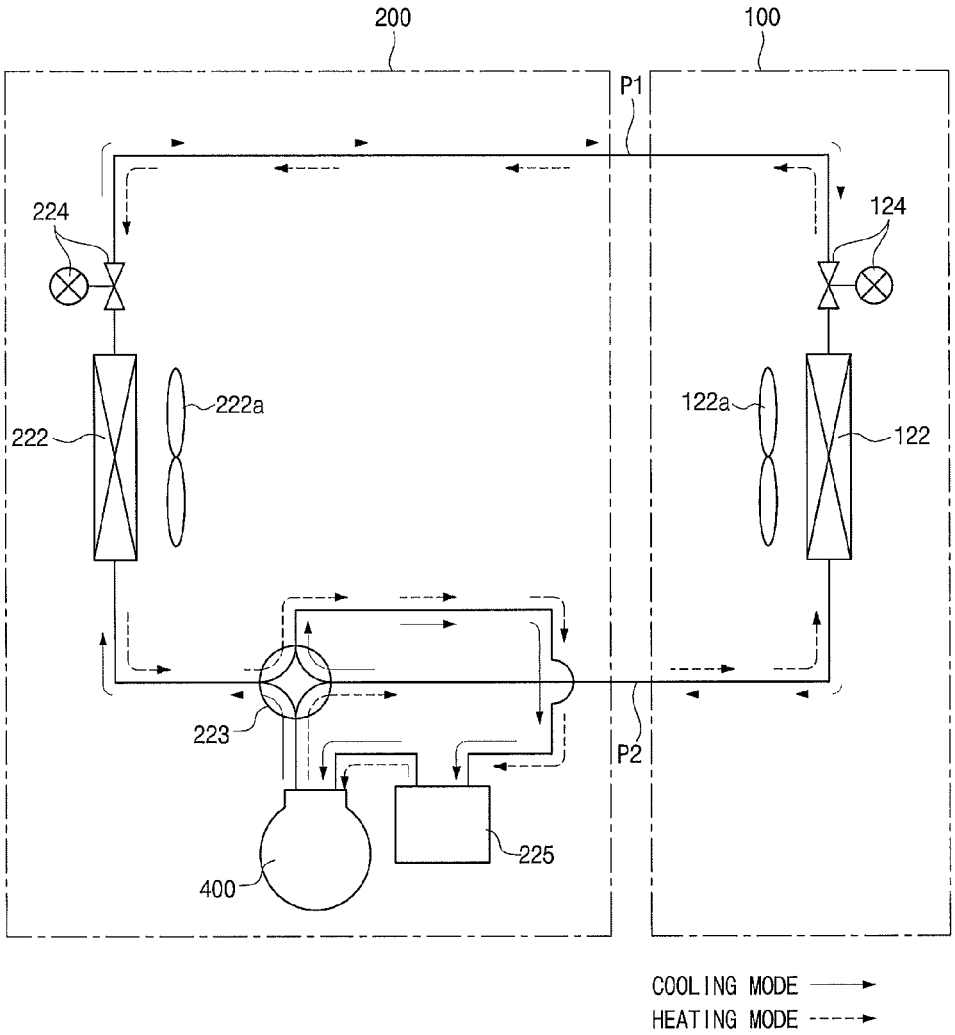
FIG. 2 is a diagram illustrating inner configurations of an indoor unit and an outdoor unit of an air conditioner according to an embodiment of the present disclosure.

FIG. 2 is a diagram illustrating inner configurations of an indoor unit 100 and an outdoor unit 200 of an air conditioner 1 according to an embodiment of the present disclosure.

Referring to FIG. 2, the air conditioner 1 further includes a gas pipe P1 serving as a channel for a gas-phase refrigerant flow and a liquid pipe P2 serving as a channel for a liquid-phase refrigerant flow in addition to the indoor unit 100 and the outdoor unit 200. The gas pipe P1 and the liquid pipe P2 are respectively connected between the indoor unit 100 and the outdoor unit 200 and elongated into the indoor unit 100 and the outdoor unit 200.

The outdoor unit 200 includes a compressor 400 to compress a refrigerant, an outdoor heat exchanger 222 to perform heat exchange between outdoor air and the refrigerant, a four-way valve 223 to guide the refrigerant compressed by the compressor 400 selectively toward the outdoor heat exchanger 222 or toward the indoor unit 100 in accordance with a heating mode or a cooling mode, an outdoor expansion valve 224 to decompress the refrigerant guided toward the outdoor heat exchanger 222 during the heating mode, and an accumulator 225 to prevent the refrigerant, which has not been evaporated, from entering the compressor 400.

The compressor 400 compresses a low-pressure gas-phase refrigerant to a high pressure using rotation force of a motor (not shown) of the compressor 400 which rotates by electric energy supplied from an external power source.

The four-way valve 223 guides the refrigerant compressed by the compressor 400 to the outdoor heat exchanger 222 during the cooling operation and guides the compressed refrigerant to the indoor unit 100 during the heating operation.

The outdoor heat exchanger 222 condenses the refrigerant compressed by the compressor 400 during the cooling operation and evaporates the refrigerant decompressed by the indoor unit 100 during the heating operation. The outdoor heat exchanger 222 may include cooling fins (not shown) of the outdoor heat exchanger 222 to improve heat exchange efficiency between outdoor air and the refrigerant by enlarging the surface area between outdoor air and a refrigerant pipe (not shown) of the outdoor heat exchanger 222 through which the refrigerant passes, and a cooling fan 222*a* to blow outdoor air to the outdoor heat exchanger 222.

The outdoor expansion valve 224 may not only decompress the refrigerant, but also control an amount of the refrigerant supplied to the outdoor heat exchanger 222 such that heat is sufficiently exchanged in the outdoor heat exchanger 222 during the heating operation. Particularly, the outdoor expansion valve 224 decompresses the refrigerant through the throttling effect by which the refrigerant is decompressed while the refrigerant passes through a narrow flow channel without heat exchange with the external environment. The outdoor expansion valve 224 may be an electronic valve, the degree of opening of which is adjustable to control the amount of the refrigerant passing through the outdoor expansion valve 224.

The indoor unit 100 includes an indoor heat exchanger 122 to perform heat exchange between indoor air and the refrigerant and an indoor expansion valve 124 to decompress the refrigerant guided into the indoor heat exchanger 122 during the cooling operation.

The indoor heat exchanger 122 evaporates a low-pressure liquid-phase refrigerant during the cooling operation and condenses a high-pressure gas-phase refrigerant during the heating operation. Similarly to the outdoor heat exchanger 222 of the outdoor unit 200, the indoor heat exchanger 122 may include cooling fins (not shown) of the indoor heat exchanger 122 to improve heat exchange efficiency between indoor air and the refrigerant by enlarging the surface area between indoor air and a refrigerant pipe (not shown) of the indoor heat exchanger 122 through which the refrigerant passes, and an air blower fan 122*a* to blow air heat-exchanged with the refrigerant by the indoor heat exchanger 122 into the indoor space.

The indoor expansion valve 124 may not only decompress the refrigerant through the throttling effect, but also control an amount of the refrigerant supplied to the indoor heat exchanger 122 such that heat is sufficiently exchanged in the indoor heat exchanger 122. The indoor expansion valve 124 may be an electronic valve, the degree of opening of which is adjustable to control the amount of refrigerant passing through the indoor expansion valve 124.

Figure 3:
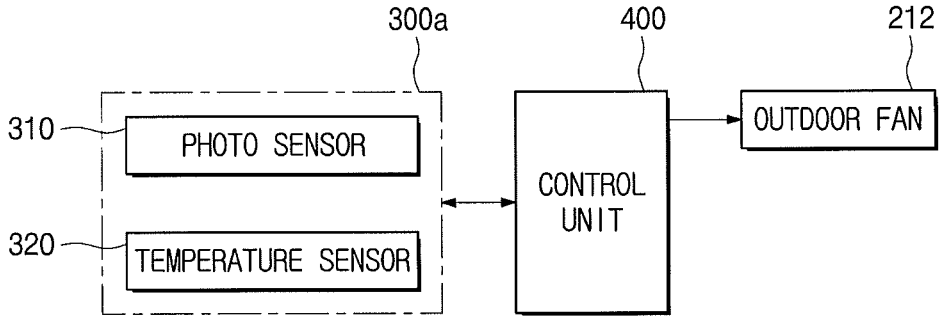
FIGS. 3 and 4 are block diagrams illustrating control configurations of air conditioners including a photo sensor according to an embodiment of the present disclosure.
Figure 4:
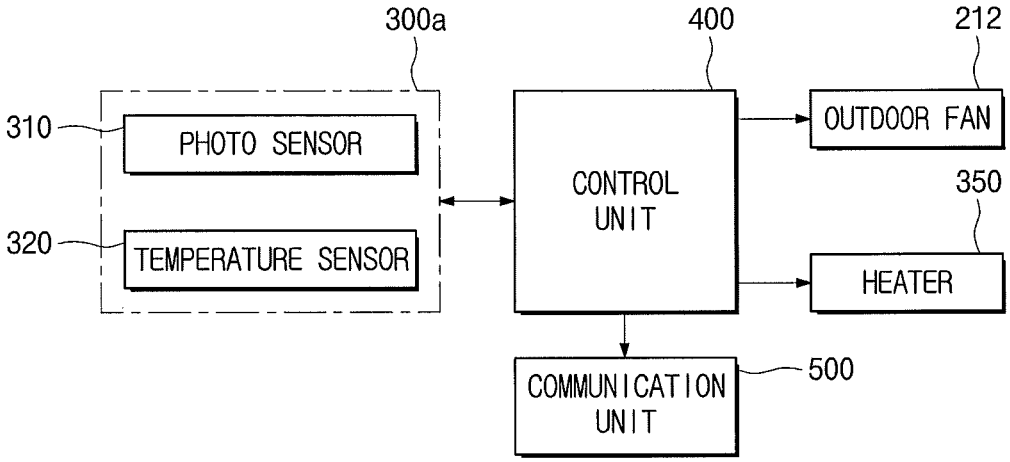

FIGS. 3 and 4 are block diagrams illustrating control configurations of air conditioners 1 according to an embodiment of the present disclosure.

Referring to FIG. 3, the air conditioner 1 includes an indoor unit (not shown), an outdoor unit 200 including an outdoor fan 212, a sensor unit 300*a* mounted at an upper portion of the outdoor unit 200 to sense snow piled up on the outdoor unit 200, and a control unit 400 to determine piling up of snow based on an output of the sensor unit 300*a* and control an operation of the outdoor fan 212 based on the determined result.

Referring to FIG. 4, the air conditioner 1 may further include a heater 350 installed as an inner structure of a sensor case to supply heat to the surroundings of the sensor unit 300*a* and a communication unit 500 for communication between a user and the air conditioner 1.

The sensor unit 300*a* includes a photo sensor 310 and a temperature sensor 320, and the photo sensor 310 and the temperature sensor 320 monitor a target area to be sensed at intervals of a predetermined time period between 10 to 60 minutes. The time interval may be modified, if desired, in order to improve the ability to sense the pilling up of snow.

The sensor unit 300*a* is fixed to the grille 213 that protects the outdoor fan 212 at a corner of the grille 213 such that the photo sensor 310 of the sensor unit 300*a* efficiently senses snow piled up on the grille 213 or foreign matter placed thereon.

The photo sensor 310 may include at least one pair of a light emitting unit and a light receiving unit and may be aligned perpendicular to the grille 213 as a post structure or parallel to the grille 213. Detailed descriptions thereof will be given later with reference to the following drawings.

The photo sensor 310 is a sensor that senses light by converting light into an electric signal, and a position sensitive detector (PSD) sensor may be used as the photo sensor 310. In the following description, for descriptive convenience, a PSD sensor will be described by way of example to describe a general principle of the photo sensor 310, and a configuration and an operational principle of the sensor unit 300*a* according to the illustrated embodiment will be described.

Meanwhile, the PSD sensor is one of various types of the photo sensor 310 and should be understood to include various types of the photo sensor 310, design modifications of which could be made by one of ordinary skill in the art.

Figure 5:
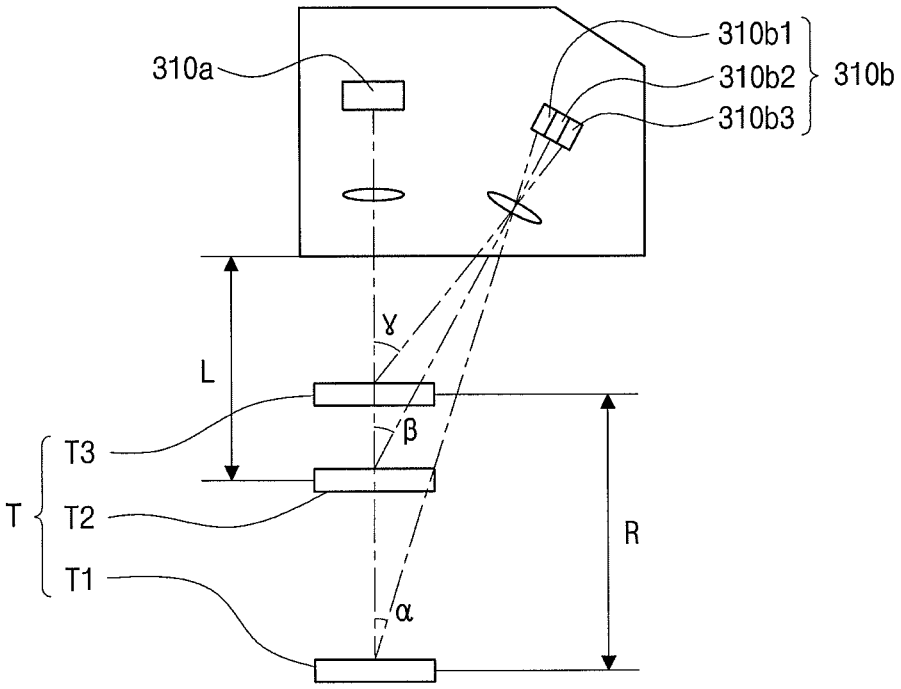
FIG. 5 is a diagram illustrating an operational principle of a position sensitive detector (PSD) sensor.

FIG. 5 is a diagram illustrating an operational principle of a position sensitive detector (PSD) sensor.

Referring to FIG. 5, the PSD sensor includes at least one pair of a light emitting unit 310*a* and a light receiving unit 310*b*, and the light receiving unit 310*b* includes a plurality of photodiodes. For descriptive convenience, FIG. 5 illustrates a first photodiode 310*b*1, a second photodiode 310*b*2, and a third photodiode 310*b*3.

The light emitting unit 310*a* and the light receiving unit 310*b* are disposed such that an interior angle between a light emitting surface and a light receiving surface is 180° C. or less. Accordingly, when the light emitting unit 310*a* emits infrared light, the infrared light collides with a target T, is reflected by the target T, and is received by one of the photodiodes. In this regard, since the photodiode receiving the reflected light is changed according to the angle of reflection of light reflected by the target T, the light receiving unit 310*b* may measure a distance from the target T by measuring the angle of reflection of light.

More particularly, when infrared light emitted from the light emitting unit 310*a* is reflected by a first target T1, the reflected infrared light is received by the first photodiode 310*b*1. When infrared light emitted from the light emitting unit 310*a* is reflected by a second target T2, the reflected infrared light is received by the second photodiode 310*b*2. When infrared light emitted from the light emitting unit 310*a* is reflected by a third target T3, the reflected infrared light is received by the third photodiode 310*b*3.

When the first photodiode 310*b*1 receives light, an angle determined by the light emitting unit 310*a*, the first target T1, and the first photodiode 310*b*1 is $\alpha$. When the second photodiode 310*b*2 receives light, an angle determined by the light emitting unit 310*a*, the second target T2, and the second photodiode 310*b*2 is $\beta$. When the third photodiode 310*b*3 receives light, an angle determined by the light emitting unit 310*a*, the third target T3, and the third photodiode 310*b*3 is $\gamma$.

In this regard, $\alpha$, $\beta$, and $\gamma$ satisfy $\alpha<\beta<\gamma$. Based on this principle, the PSD sensor senses a distance from an object.

Here, a reference distance L is determined according to arrangements of the light emitting unit 310*a* and the light receiving unit 310*b*, and a measurable range R is determined according to arrangements of the photodiodes of the light receiving unit 310*b*.

Figure 6:
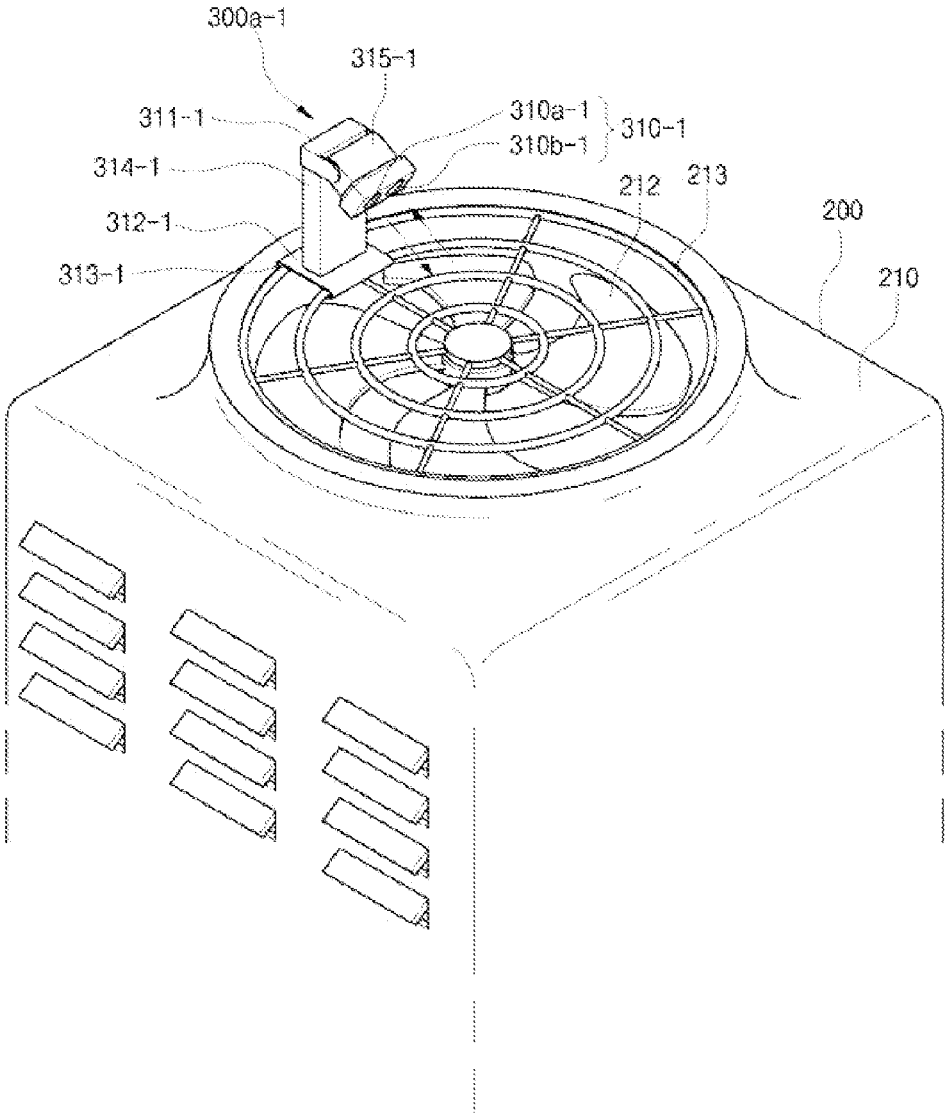
FIG. 6 is a view illustrating a sensor unit including a photo sensor according to an embodiment of the present disclosure.
Figure 7:
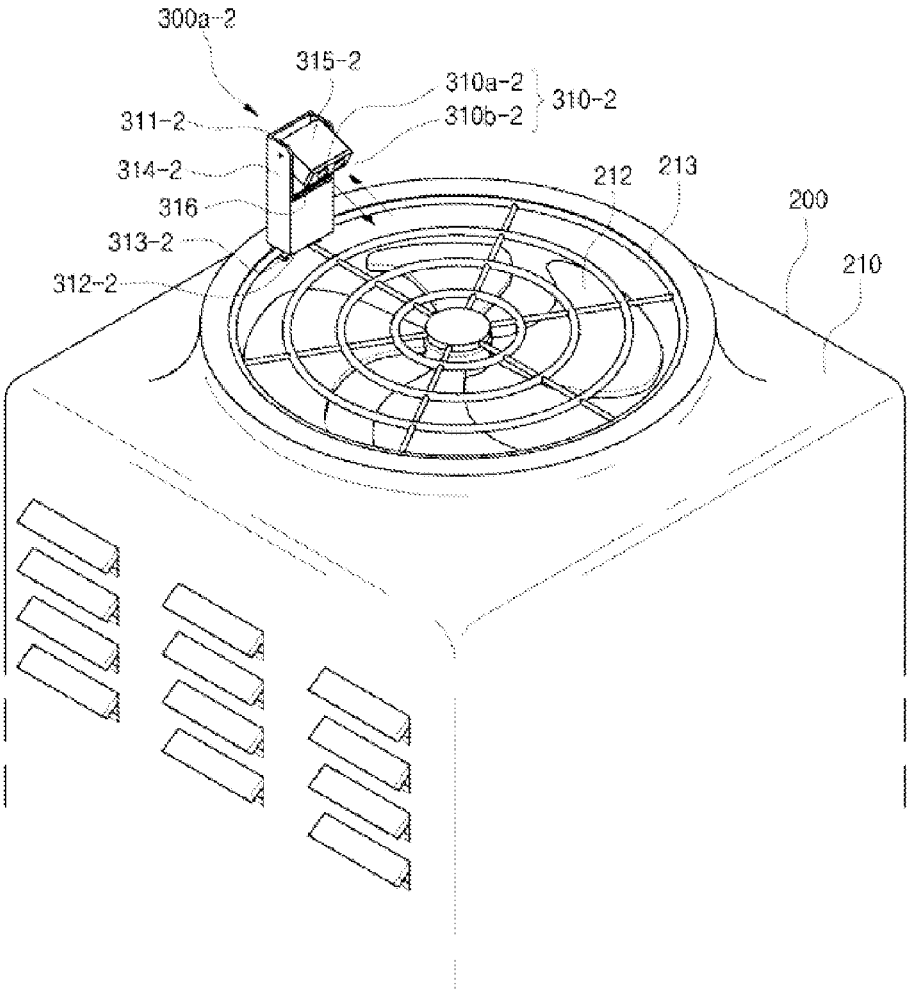
FIG. 7 is a view illustrating the sensor unit of FIG. 6 further including a motor.
Figure 8:
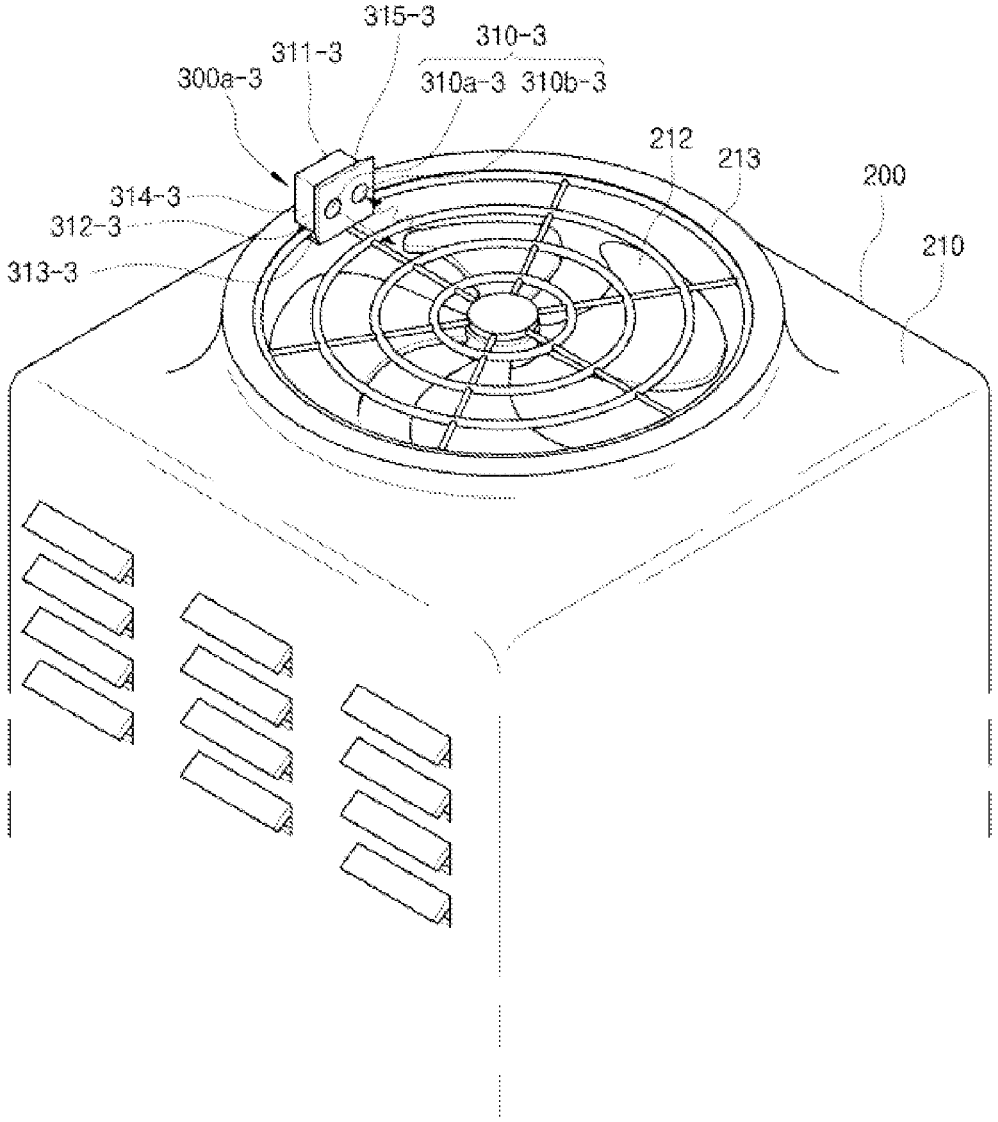
FIG. 8 is a view illustrating a sensor unit including a photo sensor according to an embodiment of the present disclosure.

FIGS. 6, 7, and 8 respectively illustrate sensor units 300*a* according to embodiments of the present disclosure. Referring to FIG. 6, a housing 311-1 of a sensor unit 300*a*-1 is provided with a fixing unit 313-1 at a bottom surface thereof to fix the sensor unit 300*a*-1 to the grille 213. The housing 311-1 includes a body 314-1 to dispose a photo sensor 310-1 to be spaced apart from the outdoor fan 212 and a head 315-1 in which the photo sensor 310-1 is mounted. A temperature sensor (not shown) may be mounted in the fixing unit 313-1, the body 314-1, or the head 315-1.

The fixing unit 313-1 may have a plurality of protrusions to be fixed to the grille 213. The body 314-1 is perpendicularly mounted on the bottom surface 312-1, and the head 315-1 may be rotatable with respect to a rotating shaft. A target area to be sensed by the photo sensor 310-1 may be changed according to a rotation angle of the head 315-1 that rotates with respect to the rotating shaft.

The photo sensor 310-1 according to the illustrated embodiment includes at least one pair of a light emitting unit 310*a*-1 and a light receiving unit 310*b*-1. When the light emitting unit 310*a*-1 emits infrared light, the infrared light collides with a target, is reflected by the target, and is received by the light receiving unit 310*b*-1.

In this regard, when snow is piled up on the grille 213, infrared light is emitted toward the piled up snow as a target. When snow is not piled up on the grille 213 and infrared light emitted from the light emitting unit 310*a*-1 is focused on an opening of the grilled 213, the infrared light passes through the opening of the grille 213.

Based on this principle, the piled up snow may be sensed by use of the angle measured by the photodiode of the light receiving unit 310*b*-1.

Referring to FIG. 7, a housing 311-2 of a sensor unit 300*a*-2 is provided with a fixing unit 313-2 at a bottom surface 312-2 thereof to fix the sensor unit 300*a*-2 to the grille 213. The housing 311-2 includes a body 314-2 to dispose a photo sensor 310-2 to be spaced apart from the outdoor fan 212 and a head 315-2 in which the photo sensor 310-2 is mounted. The head 315-2 is driven by a built-in motor. A temperature sensor (not shown) may be mounted in the fixing unit 313-2, the body 314-2, or the head 315-2.

The fixing unit 313-2 may have a plurality of protrusions to be fixed to the grille 213. The body 314-2 is perpendicularly mounted on the bottom surface 312-2, and a brush 316 mounted at one side of the body 314-2 may remove dust adhered to an entrance of the head 315-2 while passing by the brush 316 or may mitigate impact applied to the sensor when the head 315-2 is rotatably closed.

The head 315-2 is rotatable with respect to the rotating shaft, and the rotation of the head 315-2 is driven by the motor mounted in the body 314-2 of the sensor unit 300*a*-2. The head 315-2 according to the illustrated embodiment has an open/closed structure and may sense a target area while repeating opening/closing operations for a predetermined time period.

Since the operational principle of the photo sensor 310-2 according to the illustrated embodiment is the same as that of the photo sensor 310-1 of FIG. 6, descriptions thereof will not be given.

Referring to FIG. 8, a housing 311-3 of a sensor unit 300*a*-3 is provided with a fixing unit 313-3 at a bottom surface 312-3 thereof to fix the sensor unit 300*a*-3 to the grille 213. The housing 311-3 includes a body 314-3 perpendicular to the bottom surface 312-3 and a head 315-3 mounted at a side of the body 314-3 and having a built-in photo sensor 310-3. A temperature sensor (not shown) may be mounted in the fixing unit 313-3, the body 314-3, or the head 315-3.

The fixing unit 313-3 may have a plurality of protrusions to be fixed to the grille 213. The head 315-3 is mounted at one side of the body 314-3, and a light emitting unit 310*a*-3 and a light receiving unit 310*b*-3 of the photo sensor 310-3 mounted in the head 315-3 may be disposed such that light emitted from the light emitting unit 310*a*-3 proceeds parallel to the surface of the grille 213.

Since light emitted from the photo sensor 310-3 proceeds parallel to the surface of the grille 213, there is no target for light emitted from the light emitting unit 310*a*-3 under normal conditions when snow is not piled up on the grille 213. Thus, the light receiving unit 310*b*-3 receives no light or a very small amount of light, and the photodiode cannot sense an angle determined by the light emitting unit 310*a*-3, the target, and the light receiving unit 310*b*-3. However, when snow is piled up on the surface of the grille 213, the piled up snow is targeted and the angle may be sensed by a photo diode of the light receiving unit 310*b*-3. Based on this principle, the existence of the piled up snow or foreign matter may be sensed.

The heater 350 is operated such that driving performance of the sensor unit 300*a* may be maintained even in a low-temperature ambient environment and may be controlled such that the photo sensor 310 may maintain driving performance at a temperature of 0 to 50° C.

The control unit 400 determines whether the outdoor unit 200 is in operation or not, and then rotates the outdoor fan 212 in an operation mode when the outdoor unit 200 is in operation or turns off the outdoor fan 212 when the operation of the outdoor unit 200 is stopped. Hereinafter, a case that the operation of the outdoor unit 200 of the air conditioner 1 is stopped will be described for descriptive convenience.

The control unit 400 determines whether snow is piled up or not based on an output from the sensor unit 300*a* and controls the operation of the outdoor fan 212 based on the determined result.

The control unit 400 determines that snow or foreign matter is piled up or not when the output of the photo sensor 310 is changed and the changed output is maintained for a predetermined first time period.

More particularly, when the location of the photodiode is changed in the light receiving unit 310*b* of the photo sensor 310, the control unit 400 recognizes the change using an electric signal and detects the existence of snow or foreign matter.

Upon determining that snow or foreign matter does not exist, the photo sensor 310 returns to an initial state and monitors the target area to be sensed.

Upon determining that snow or foreign matter exists, the control unit 400 determines that snow is piled up when an output from the temperature sensor 320 is less than a predetermined first temperature or determines that foreign matter is placed when the output from the temperature sensor 320 is greater than the predetermined first temperature.

When snow is piled up, the control unit 400 may remove the piled up snow by controlling the operation of the outdoor fan 212 and by controlling driving of the heat unit 350 to supply heat thereto in addition to the operation of the outdoor fan 212.

When there is foreign matter, the control unit 400 may remove the foreign matter by driving the outdoor fan 212.

The first temperature may be predetermined in the range of 0 to 10° C.

The communication unit 500 is mounted at one side of the outdoor unit 200. When the control unit 400 determines that the piled up snow or foreign matter is not removed, the communication unit 500 informs a user of the determined result.

More particularly, the control unit 400 determines that the pile up snow or foreign matter is not removed when the changed output from the photo sensor 310 is maintained, and informs the user that the piled up snow or foreign matter is not removed via the communication unit 500.

Figure 9:
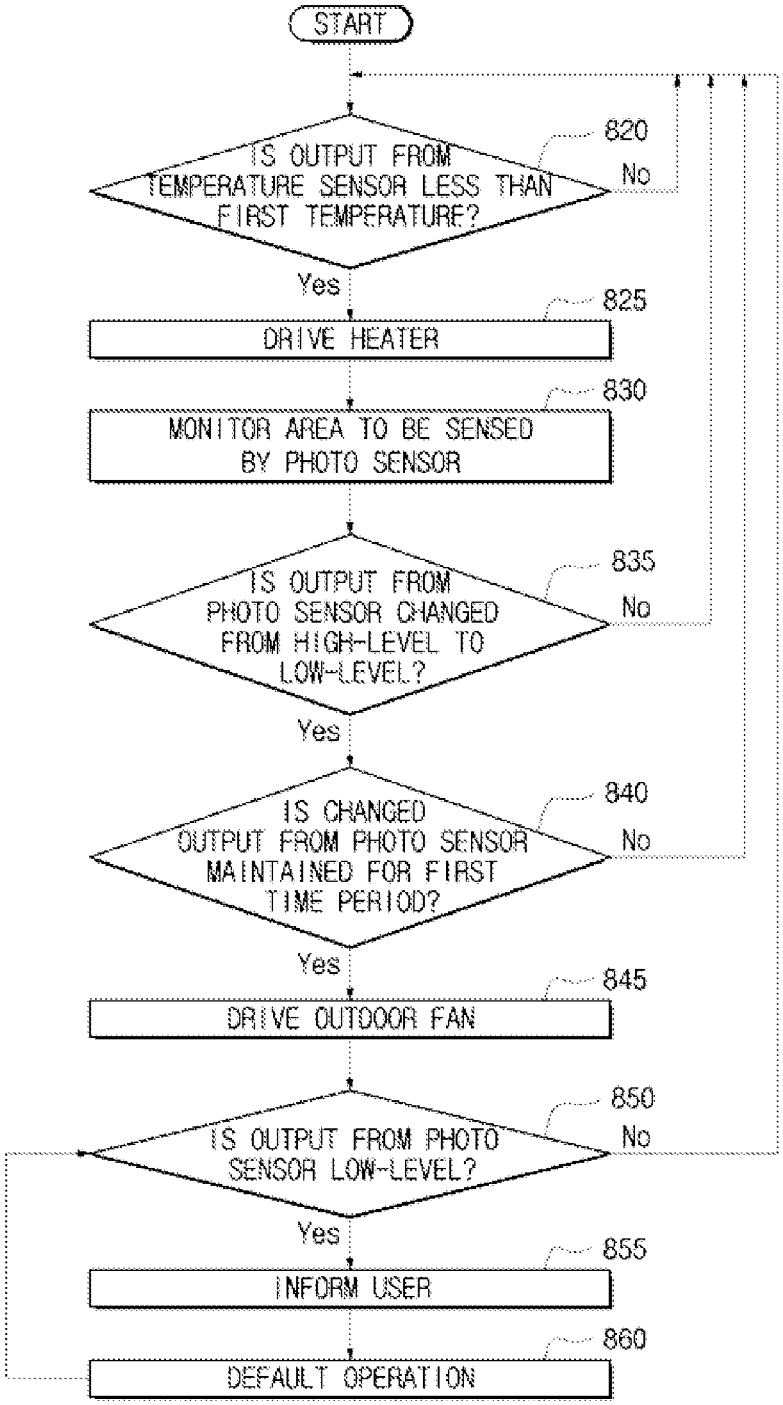
FIG. 9 is a flowchart illustrating a method of controlling the air conditioners of FIGS. 3 and 4.

FIG. 9 is a flowchart illustrating a method of controlling the air conditioners 1 of FIGS. 3 and 4. The method of controlling the air conditioner 1 will be described in detail with reference to FIG. 9.

The method of controlling the air conditioner 1 includes determining that snow is piled up when a temperature output from the temperature sensor 320 is less than a predetermined first temperature, the output of the photo sensor 310 is changed, and the changed output is maintained for a predetermined first time period, and removing the piled up snow by driving the outdoor fan 212.

The method may also include controlling the heat unit 350 to supply heat by controlling driving of the heater 350 while controlling the operation of the outdoor fan 212 to remove the piled up snow.

Meanwhile, since the outdoor fan 212 is operated whenever the air conditioner 1 is operated, separate driving of the outdoor fan 212 is not required to remove the piled up snow or foreign matter. Thus, a method of controlling the air conditioner 1 while operation of the air conditioner 1 is stopped will be described in detail. Hereinafter, the method of controlling the air conditioner 1 will be described by way of example and design modifications thereof could be made by one of ordinary skill in the art.

Referring to FIG. 9, the control unit 400 controls the temperature sensor 320 to monitor a target area to be sensed when the operation of the outdoor unit 200 is stopped. In response to the control by the control unit 400, the temperature sensor 320 senses outdoor conditions and outputs sensed results to the control unit 400.

The control unit 400 determines that snow is piled up when a temperature output from the temperature sensor 320 is less than the predetermined first temperature and determines that there is foreign matter when a temperature output from the temperature sensor 320 is greater than the predetermined first temperature (820).

Upon determining that snow is piled up, the control unit 400 controls driving of the heater 350 to supply heat and controls the photo sensor 310 to monitor the target area. The photo sensor 310 monitors the target area in response to the control by the control unit 400 and outputs monitored results to the control unit 400 of the outdoor unit 200 (825 and 830). In the following description, for descriptive convenience, a case in which a sensing signal of the photo sensor 310 is output as a high-level signal when snow is not piled up and as a low-level signal when snow is piled up will be described by way of example.

The control unit 400 determines that the piled up snow is removed when the output from the photo sensor 310 is not changed from the high-level to the low-level. On the contrary, when the output from the photo sensor 310 is changed from the high-level to the low-level, the control unit 400 determines whether the changed output is maintained for a first time period. The control unit 400 determines that the piled up snow is removed when the low-level is not maintained for the first time period and determines that the piled up snow is not removed when the low-level is maintained for the first time period (835 and 840).

When the piled up snow is not removed, the control unit 400 controls driving of the outdoor fan 212 to perform a process of removing the piled up snow (845). Here, the heater 350 may be continuously driven to supply heat, thereby facilitating driving of the sensor unit 300*a*.

In this regard, the heater 350 may be controlled such that the photo sensor 310 is operated at a temperature of 0 to 50° C., preferably, at room temperature of 24 to 26° C. to maintain driving performance at a low ambient temperature.

The control unit 400 determines that the piled up snow is removed when the output from the photo sensor 310 is not maintained at the low-level after controlling the operation of the outdoor fan 212. On the contrary, when the output from the photo sensor 310 is maintained at the low-level, the control unit 400 determines that the piled up snow is not removed and inform a user of the determined result (850 and 855).

The control unit 400 may control the outdoor fan 212 to perform a default operation in which the outdoor fan 212 is operated at predetermined time intervals until the piled up snow is removed after informing the user that the piled up snow is not removed (860).

Figure 10:
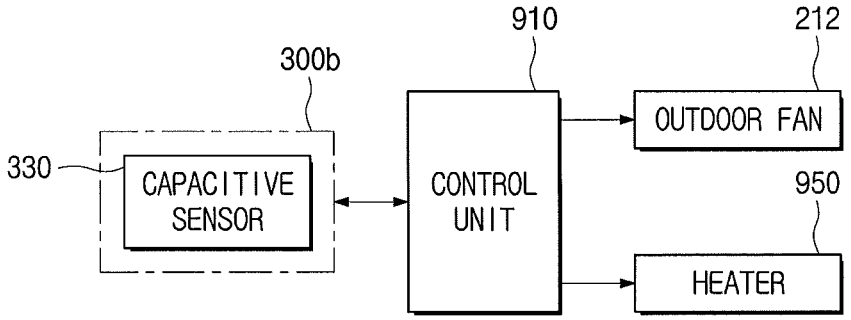
FIGS. 10 and 11 are block diagrams of control configurations of air conditioners including a capacitive sensor according to an embodiment of the present disclosure.
Figure 11:
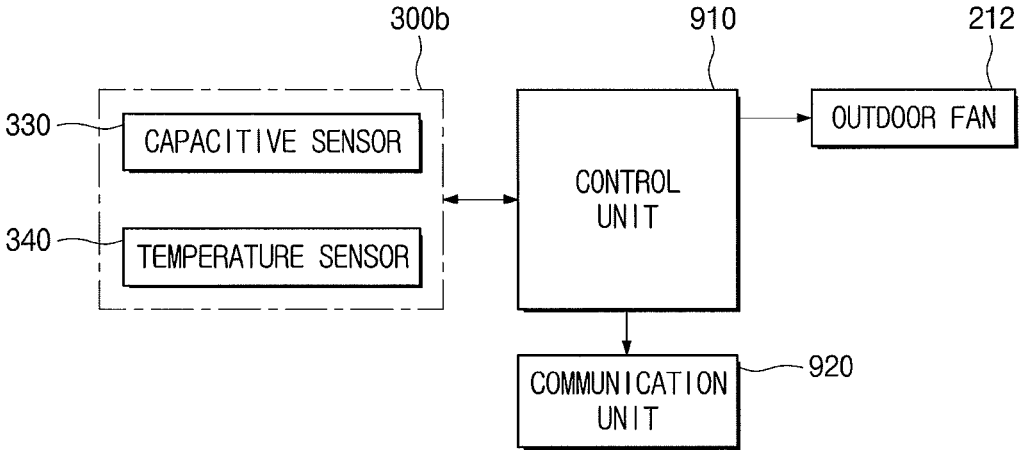

Hereinafter, the air conditioner 1 according to an embodiment of the present disclosure will be described in detail with reference to functional block diagrams indicating control configurations as illustrated in FIGS. 10 and 11.

Referring to FIG. 10, the air conditioner 1 includes an indoor unit (not shown), an outdoor unit 200 including an outdoor fan 212, a sensor unit 300*b* mounted at an upper portion of a grille 213 of the outdoor unit 200 to sense snow piled up on the outdoor unit 200, and a control unit 910 to determine whether snow is piled up or not based on an output of the sensor unit 300*b* and control an operation of the outdoor fan 212 to remove the piled up snow based on the determined result. The air conditioner 1 may further include a heater 950 mounted in the bottom surface 332 of the sensor unit to supply heat to the surroundings of the sensor unit 300*b*.

In addition, referring to FIG. 11, the air conditioner 1 according to an embodiment of the present disclosure may further include a temperature sensor 340 in the sensor unit 300*b* and a communication unit 920 for communication with the user.

The sensor unit 300*b* of the air conditioner 1 according to the illustrated embodiment includes a capacitive sensor 330 and a temperature sensor 340. The sensor unit 300*b* is fixed to the grille 213 that protects the outdoor fan 212 at a corner of the grille 213 such that the photo sensor 310 of the sensor unit 300*b* efficiently senses snow piled up on the grille 213 or foreign matter placed thereon.

Hereinafter, the configuration of the sensor unit 300*b* of the air conditioner 1 according to the illustrated embodiment will be described in more detail.

Figure 12A:
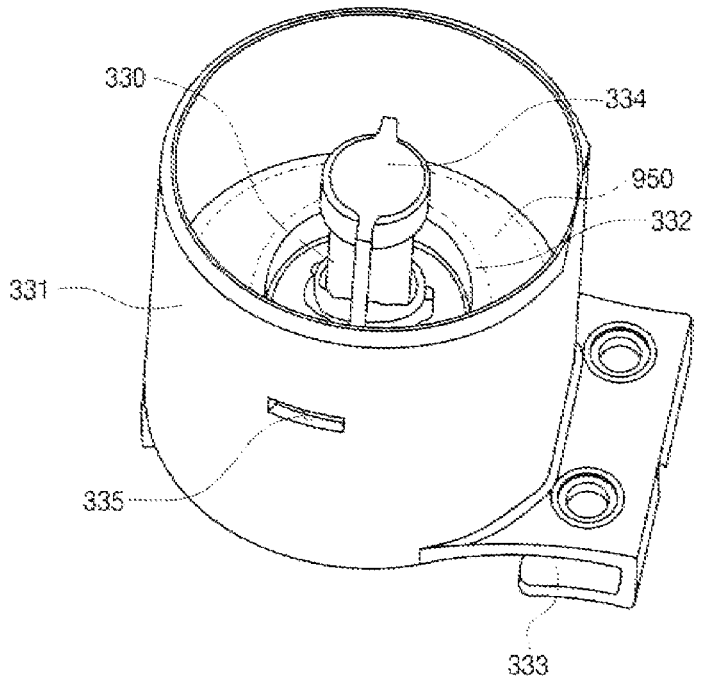
FIG. 12A is a perspective view illustrating a sensor unit including a capacitive sensor.
Figure 12B:
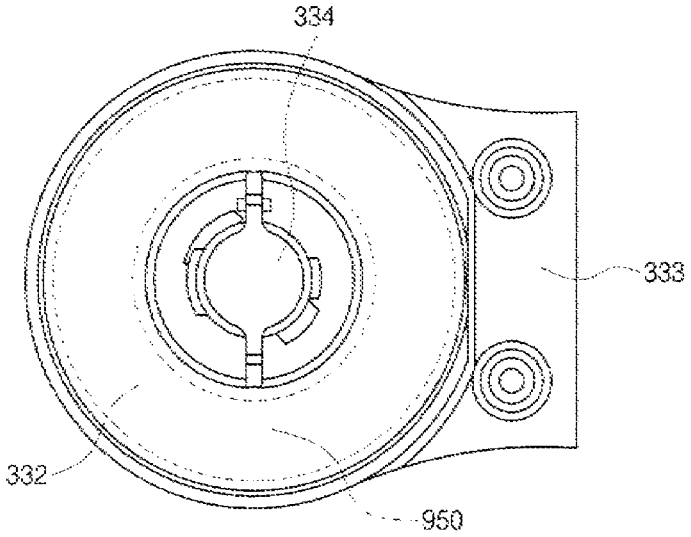
FIG. 12B is a plan view of the sensor unit including the capacitive sensor.

FIG. 12A is a perspective view illustrating the sensor unit 300*b* of the air conditioner 1 according to an embodiment of the present disclosure, and FIG. 12B is a plan view of the sensor unit 300*b*. Referring to FIGS. 12A and 12B, an appearance of the sensor unit 300*b* according to the illustrated embodiment is defined by a housing 331. A capacitive sensor 330 is mounted in the housing 331, and a temperature sensor (not shown) and a heater 950 are mounted on the bottom surface 332.

The housing 331 has a cylindrical shape and is provided with a fixing unit 333 at one side of the bottom surface 332 to fix the housing 331 to the surface of the grille 213.

The capacitive sensor 330 may be disposed at a central region of the bottom surface 332, and a cover 334 for protection thereof may be installed at an upper portion of the capacitive sensor 330. A surface of the bottom surface 332 which contacts with the outdoor unit 200 may protrude toward the outdoor unit 200 such that snow is efficiently collected in the sensor unit 300*b*.

A drain portion 335 may be formed at a side of the housing 331 such that snow piled in the inner space of the sensor unit 300*b* or snow melt water is drained.

The capacitive sensor 330 is a sensor that quantifies physical properties using capacitance effect and uses a principle in which electric charges are stored when an electric potential is applied to a conductive material. The capacitive sensor 330 according to the illustrated embodiment may employ a parallel plate model. In the following description, an operational principle of the capacitive sensor 330 using a parallel plate model will be described in detail for descriptive convenience.

In the parallel plate model, when sizes of two plates are greater than a distance between the two plates, $C=\epsilon \cdot A/d$ may be obtained.

In the formula, $\epsilon$ is permittivity, A is area of an overlap portion of the two plates, d is distance between the two plates. Permittivity $\epsilon$ is calculated by multiplying a vacuum permittivity by a relative permittivity, which is intrinsic property of a material.

Water has permittivity of about 80 F/m (Farad per meter) which is about 20 to 30 times greater than that of snow and about 70 to 80 times greater than air.

The air conditioner 1 senses piled up snow by using a change of an output from the capacitive sensor 330 caused by such permittivity difference. More particularly, the capacitive sensor 330 outputs a low-level signal in case of snow and air having relatively lower permittivity and outputs a high-level signal in case of water having relatively higher permittivity. Piling up or removal of snow may be sensed by use thereof.

The heater 950 is operated such that driving performance of the sensor unit 300*b* may be maintained in a low-temperature ambient environment and may be driven such that the capacitive sensor 330 may maintain driving performance at a temperature of 0 to 50° C.

The control unit 910 determines whether the outdoor unit 200 is in operation or not, and then rotates the outdoor fan 212 in an operation mode when the outdoor unit 200 is in operation or turns off the outdoor fan 212 when the operation of the outdoor unit 200 is stopped. Hereinafter, a control process by the control unit 910 when the operation of the outdoor unit 200 of the air conditioner 1 is stopped will be described for descriptive convenience.

The control unit 910 drives the heater 950 and determines that snow is piled up when an output from the capacitive sensor 330 is changed after driving of the heater 950 and the changed output is maintained for a predetermined second time period. Upon determining that snow is piled up, the heater 950 is driven to continuously supply heat to remove the piled up snow.

More particularly, the control unit 910 controls driving of the heater 950 to melt snow piled up around the capacitive sensor 330 into water in an area to be sensed by the capacitive sensor 330.

When snow is melted into water in the area to be sensed in the capacitive sensor 330, electrostatic capacity of the capacitive sensor 330 is changed, and the output from the capacitive sensor 330 is changed in accordance with the electrostatic capacity. In this regard, since water has a relatively greater electrostatic capacity than snow, the output from the capacitive sensor 330 is changed from the low-level to the high-level. The change of the electrostatic capacity sensed by the capacitive sensor 330 is output to the control unit 910 as an electric signal, and thus the control unit 910 determines whether snow is piled up or not.

Upon determining that snow is piled up, the control unit 910 continuously drives the heater 950 to continuously supply heat or drives the outdoor fan 212 of the outdoor unit 200 to remove snow.

After removing the piled up snow, the control unit 910 controls the capacitive sensor 330 to output the sensed results to the control unit 910. In response to the control by the control unit 910, the capacitive sensor 330 senses outdoor conditions and outputs sensed results to the control unit 910.

When water is completely evaporated or snow is completely sublimated, only air having a relatively low permittivity is remained in the area to be sensed by the capacitive sensor 330, and the output from the capacitive sensor 330 is changed from the high-level to the low-level.

Thus, when the output from the capacitive sensor 330 is not maintained at the high-level, the control unit 910 determines that the piled up snow is removed and controls the driving of the heater in a stop state. When the output from the photo sensor 310 is maintained at the low-level, the control unit 910 determines that the piled up snow is not removed and informs the user of the determined result.

The communication unit 920 is mounted at one side of the outdoor unit 200. When the control unit 910 determines that the piled up snow is not removed, the communication unit 500 informs a user of the determined result.

Figure 13:
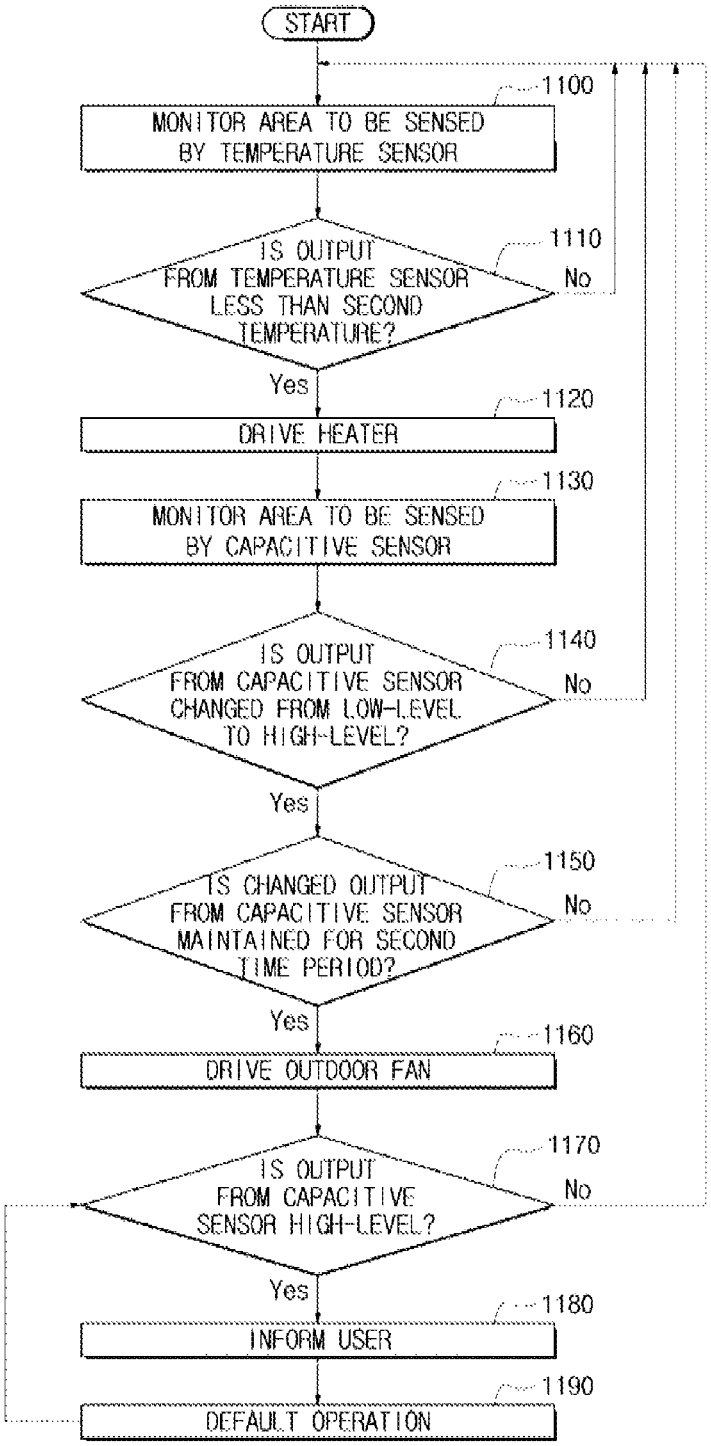
FIG. 13 is a flowchart illustrating a method of controlling the air conditioner of FIG. 11.

FIG. 13 is a flowchart illustrating a method of controlling the air conditioner 1 of FIG. 11. The method of controlling the air conditioner 1 according to an embodiment of the present disclosure will be described in detail with reference to FIG. 13.

The method of controlling the air conditioner 1 according to the illustrated embodiment includes driving the heater 950, determining that snow is piled up when an output from the capacitive sensor 330 is changed after driving of the heater 950 and the changed output is maintained for a predetermined second time period, and driving the heater 950 to continuously supply heat or driving the outdoor fan 212 of the outdoor unit 200 to remove the piled up snow when it is determined that snow is piled up.

In addition, according to the method of controlling the air conditioner 1 according to the illustrated embodiment, the sensor unit 300*b* of the air conditioner 1 further includes a temperature sensor 340, and the method may further include driving the heater 950 when an output from the temperature sensor 340 is less than a predetermined second temperature. In this regard, the temperature sensor 340 may be mounted in the outdoor unit of the air conditioner 1.

Meanwhile, since the outdoor fan 212 is operated whenever the air conditioner 1 is operated, separate driving of the outdoor fan 212 is not required to remove the piled up snow or foreign matter. Thus, a method of controlling the air conditioner 1 including the sensor unit 300*b* having the temperature sensor 340 while the operation of the air conditioner 1 is stopped will be described in detail.

According to the method of controlling the air conditioner 1, the temperature sensor 340 monitors the target area to be sensed and outputs monitored results to the control unit 910 (1100).

Based on the results from temperature sensor 340, when temperature of the target area is less than a second temperature, the heater 950 is driven to supply heat to the surroundings of the capacitive sensor 330 (1110 and 1120). When snow is piled up around the capacitive sensor 330, snow is melted into water by heat supplied by the heater 950.

Then, the capacitive sensor 330 is controlled to monitor the target area. Since water has greater electrostatic capacity than snow, permittivity around the capacitive sensor 330 increases by water generated by the heater 950, thereby changing the output from the capacitive sensor 330. More particularly, the output from the capacitive sensor 330 is changed from the low-level to the high-level (1130). When the output from the capacitive sensor 330 is changed from the low-level to the high-level, the control unit 910 determines whether the changed output is maintained for the second time period (1140 and 1150). The control unit 910 determines that snow is not piled up, when the changed output is not maintained for the second time period and determines that snow is pile up, when the changed output is maintained for the second time period.

Upon determining that snow is piled up, the control unit 910 simultaneously controls the heater 950 to continuously supply heat to the surroundings of the capacitive sensor 330 and drives the outdoor fan 212 of the outdoor unit 1200 to remove the piled up snow (1160). When the piled up snow is removed, air is sensed by the capacitive sensor 330 in the target area, and thus the output from the capacitive sensor 330 is changed from the high-level to the low-level.

The control unit 910 controls the heater 950 to supply heat to the surroundings of the capacitive sensor 330, the outdoor fan 212 of the outdoor unit 200, and the capacitive sensor 330 to monitor the target area after a predetermined time period and output monitored results to the control unit 910. The control unit 910 analyzes the results output from the capacitive sensor 330, determines that snow is not removed when the capacitive sensor 330 outputs the high-level signal, and informs a user of the determined results via a communication unit (1170 and 1180).

In this regard, the control unit 910 may control the outdoor fan 212 to perform a default operation in which the outdoor fan 212 is operated at predetermined time intervals until the piled up snow is removed after informing the user that the piled up snow is not removed (1190).

Then, the control unit 910 determines that the piled up snow is removed when the capacitive sensor 330 outputs a low-level signal, i.e., when the output is changed from the high-level to the low level, and controls the heater 950 and the outdoor fan 212 to be initialized.

As is apparent from the above description, a snow sensing system according to an embodiment of the present disclosure senses snow using a photo sensor or a capacitive sensor and drives an outdoor unit of the air conditioner when snow is piled up thereon.

In addition, snow is sensed by using the photo sensor or the capacitive sensor and is melted by driving a heater.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. An air conditioner comprising:

an indoor unit;

an outdoor unit comprising an outdoor fan;

a sensor unit mounted at an upper portion of the outdoor unit to sense snow piled up on the outdoor unit;

a heater disposed around the sensor unit to maintain operational performance at a low temperature and supply heat to surroundings of the sensor unit; and a control unit to determine whether snow is piled up or not based on an output from the sensor unit and control an operation of the outdoor fan to remove snow when snow is piled up, wherein the sensor unit comprises a photo sensor and a temperature sensor.

2. The air conditioner according to claim 1, wherein the control unit determines that snow is piled up when an output from the temperature sensor is less than a predetermined first temperature, an output from the photo sensor is changed, and the changed output is maintained for a predetermined first time period.

3. The air conditioner according to claim 1, wherein the control unit simultaneously controls an operation of the outdoor fan and controls the heater to supply heat while removing the piled up snow.

4. The air conditioner according to claim 1, wherein the control unit determines that foreign matter exists when an output from the temperature sensor is greater than a predetermined first temperature and an output from the photo sensor is changed.

5. The air conditioner according to claim 1, wherein the photo sensor is a position sensitive detector (PSD) sensor.

6. An air conditioner comprising:

an indoor unit;

an outdoor unit comprising an outdoor fan;

a sensor unit mounted at an upper portion of the outdoor unit to sense snow piled up on the outdoor unit;

a heater disposed around the sensor unit to supply heat to surroundings of the sensor unit; and a control unit to determine whether snow is piled up or not based on an output from the sensor unit and control an operation of the outdoor fan to remove snow when snow is piled up based on the determination, wherein the sensor unit comprises a capacitive sensor.

7. The air conditioner according to claim 6, wherein the control unit:

drives the heater;

determines that snow is piled up when an output from the capacitive sensor is changed after snow is melted into water by driving of the heater and the changed output is maintained for a predetermined second time period; and drives the heater to continuously supply heat or controls an operation of the outdoor fan to remove the piled up snow when snow is piled up.

8. The air conditioner according to claim 6, wherein the sensor unit further comprises a temperature sensor, and the control unit controls driving of the heater to melt snow when an output from the temperature sensor is less than a predetermined second temperature when the driving of the heater is determined.

9. A method of controlling an air conditioner comprising an indoor unit, an outdoor unit comprising an outdoor fan, and a sensor unit mounted at an upper portion of the outdoor unit to sense snow piled up on the outdoor unit, wherein the sensor unit comprises a photo sensor and a temperature sensor, the method comprising:

determining that snow is piled up when an output from the temperature sensor is less than a predetermined first temperature, an output from the photo sensor is changed and the changed output is maintained for a predetermined first time period; and removing the piled up snow by driving the outdoor fan, wherein the air conditioner further comprises a heater around the sensor unit, and the heater is controlled to supply heat while controlling an operation of the outdoor fan when the piled up snow is removed.

10. The method according to claim 9, wherein it is determined that foreign matter exists when an output from the temperature sensor is greater than a predetermined first temperature.

11. A method of controlling an air conditioner comprising an indoor unit, an outdoor unit comprising an outdoor fan, a sensor unit mounted at an upper portion of the outdoor unit to sense snow piled up on the outdoor unit, and a heater disposed around the sensor unit, wherein the sensor unit comprises a capacitive sensor, the method comprising:

driving the heater;

determining that snow is piled up when an output from the capacitive sensor is changed after driving of the heater, and the changed output is maintained for a predetermined second time period; and controlling the heater to continuously supply heat or the outdoor fan to remove the pile up snow when it is determined that snow is piled up.

12. The method according to claim 11, wherein the sensor unit further comprises a temperature sensor, and the heater is driven when an output from the temperature sensor is less than a predetermined second temperature.

13. The air conditioner according to claim 1, further comprising a grille to protect the outdoor fan, wherein the sensor unit is fixed to the grill and adapted to sense snow piled up on the grille or foreign matter placed on the grille.

14. The air conditioner according to claim 13, wherein the photo sensor includes at least one pair of a light emitting unit and a light receiving unit and is aligned perpendicular to the grille as a post structure.

15. The air conditioner according to claim 13, wherein the photo sensor includes at least one pair of a light emitting unit and a light receiving unit and is aligned parallel to the grille.

* * * * *